US010369576B2

(12) United States Patent
Cho et al.

(10) Patent No.: US 10,369,576 B2
(45) Date of Patent: Aug. 6, 2019

(54) ELECTRICAL DUST-COLLECTING FILTER

(71) Applicants: Hyundai Motor Company, Seoul (KR); Hanon Systems, Daejeon (KR)

(72) Inventors: Kwang Woon Cho, Gyeonggi-do (KR); Dae Ik Jung, Gyeonggi-do (KR); Keon Soo Jin, Ulsan (KR); Ji Yong Park, Daejeon (KR)

(73) Assignees: Hyundai Motor Company, Seoul (KR); Hanon Systems, Daejeon (KR)

( * ) Notice: Subject to any disclaimer, the term of this patent is extended or adjusted under 35 U.S.C. 154(b) by 127 days.

(21) Appl. No.: 15/240,131

(22) Filed: Aug. 18, 2016

(65) Prior Publication Data

US 2017/0120255 A1 May 4, 2017

(30) Foreign Application Priority Data

Nov. 3, 2015 (KR) ..... 10-2015-0153550

(51) Int. Cl.

| | |
|---|---|
| ***B03C 3/45*** | (2006.01) |
| ***B03C 3/86*** | (2006.01) |
| ***B03C 3/12*** | (2006.01) |
| ***B03C 3/08*** | (2006.01) |
| ***B03C 3/41*** | (2006.01) |
| ***B03C 3/47*** | (2006.01) |
| ***B03C 3/78*** | (2006.01) |

(52) U.S. Cl.

CPC ..... *B03C 3/45* (2013.01); *B03C 3/08* (2013.01); *B03C 3/12* (2013.01); *B03C 3/41* (2013.01); *B03C 3/47* (2013.01); *B03C 3/78* (2013.01); *B03C 3/86* (2013.01)

(58) Field of Classification Search

CPC combination set(s) only.
See application file for complete search history.

(56) References Cited

U.S. PATENT DOCUMENTS 3,026,964 A * 3/1962 Penney ..... B03C 3/12 96/74
3,704,572 A * 12/1972 Gourdine ..... B03C 3/12 96/58
4,231,766 A * 11/1980 Spurgin ..... B03C 3/12 96/79

(Continued)

FOREIGN PATENT DOCUMENTS

JP 06165949 A * 6/1994
JP 10-263434 A 6/1998

(Continued)

*Primary Examiner* — Amber R Orlando
*Assistant Examiner* — Sonji Turner
(74) *Attorney, Agent, or Firm* — Mintz Levin Cohn Ferris Glovsky and Popeo, P.C.; Peter F. Corless

(57) ABSTRACT

An electrical dust-collecting filter is provided. The electrical dust-collecting filter includes a dust-collecting unit having a dust-collecting body and dust-collecting electrodes configured to generate an electrical field in the dust-collecting body. The dust-collecting body has a plurality of air channels laterally formed therethrough and discharge apertures formed in upper and lower surfaces thereof at inlets of the plurality of air channels. A discharge unit is integrally formed with the dust-collecting unit at the inlets of the plurality of air channels to facilitate corona discharge in air introduced into the inlets of the plurality of air channels.

8 Claims, 4 Drawing Sheets

(56) References Cited

U.S. PATENT DOCUMENTS 5,215,558 A * 6/1993 Moon ..... B03C 3/41 96/62
5,466,279 A * 11/1995 Hattori ..... B03C 3/12 29/25.01
5,484,473 A * 1/1996 Bontempi ..... B03C 3/025 96/100
5,925,170 A * 7/1999 Nojima ..... B03C 3/40 96/71
5,950,424 A * 9/1999 Nojima ..... B03C 3/011 55/DIG. 30
5,958,112 A * 9/1999 Nojima ..... B03C 3/32 55/359
6,193,788 B1 * 2/2001 Nojima ..... B03C 3/40 29/34 R
6,368,392 B1 * 4/2002 Ohtake ..... B03C 3/38 96/100
6,506,238 B1 * 1/2003 Endo ..... B03C 3/12 96/79
6,635,106 B2 * 10/2003 Katou ..... B03C 3/12 96/67
7,473,304 B2 * 1/2009 Besi ..... B01D 46/50 422/121
7,655,076 B2 * 2/2010 Griffiths ..... B03C 3/011 96/64
7,942,952 B2 * 5/2011 Gale ..... B03C 3/08 96/63
8,192,535 B2 * 6/2012 Tanaka ..... B03C 3/09 96/98
8,192,536 B2 * 6/2012 Tanaka ..... B03C 3/09 96/98
8,385,041 B2 * 2/2013 Goudy, Jr. ..... B03C 3/08 361/230
8,411,406 B2 * 4/2013 Goudy, Jr. ..... B03C 3/08 361/230
8,690,996 B2 * 4/2014 Jl ..... C25B 11/02 95/79
2010/0067164 A1 * 3/2010 Goudy, Jr. ..... B03C 3/08 361/225
2010/0147676 A1 * 6/2010 Goudy, Jr. ..... B03C 3/08 204/164

FOREIGN PATENT DOCUMENTS

JP 2006-068581 A 3/2006
KR 20-0363531 Y1 10/2004
KR 2008-0098567 A 11/2008
KR 10-2011-0088744 A 8/2011
KR 10-2014-0111784 A 9/2014
WO 2008/092083 A2 7/2008

* cited by examiner

ELECTRICAL DUST-COLLECTING FILTER

CROSS-REFERENCE TO RELATED APPLICATION

This application claims under 35 U.S.C. § 119(a) the benefit of priority to Korean Patent Application No. 10-2015-0153550 filed on Nov. 3, 2015, the entire contents of which are incorporated herein by reference.

BACKGROUND (a) Technical Field

The present disclosure relates to an electrical dust-collecting filter and more particularly, to an electrical dust-collecting filter, having an integrally constructed discharge unit and dust-collecting unit.

(b) Background Art

Typically, as known in the art, an air conditioning apparatus, such as an air conditioner, an air purifier or the like, may include a dust-collecting filter adapted to filter contaminants such as fine dust contained in exterior or interior air. Generally, a non-woven filter, typically applied to a vehicular air conditioner, may be equipped with a filter paper, which includes a layered structure to physically remove fine dust in the air.

Although the non-woven filter is manufactured to include a filter paper with multiple layers to increase the collection efficiency of fine dust in a physical manner, there are several disadvantages. Namely, the disadvantages include an increased loss of air pressure, reduction of the service life and frequent replacement. To overcome these disadvantages, an electrical dust-collecting filter, constructed to mitigate the loss of air pressure and to extend the service life through appropriate management, is applied to an air conditioning apparatus.

The above information disclosed in this section is merely for enhancement of understanding of the background of the invention and therefore it may contain information that does not form the prior art that is already known in this country to a person of ordinary skill in the art.

SUMMARY

The present invention provides an electrical dust-collecting filter, with a discharge unit integrally constructed to include a dust-collecting unit at the inlets of air channels of the dust-collecting unit to reduce the size and volume of the filter. For example, the electrical dust-collecting filter may be disposed within a narrow space in a vehicle in which an air conditioning apparatus may be positioned.

In one aspect, the present invention provides an electrical dust-collecting filter that may include a dust-collecting unit having a dust-collecting body and dust-collecting electrodes that may be configured to generate an electrical field in the dust-collecting body. The dust-collecting body may include a plurality of air channels laterally formed therethrough and discharge apertures formed in upper and lower surfaces thereof at inlets of the plurality of air channels. A discharge unit may be integrally formed with the dust-collecting unit at the inlets of the plurality of air channels and may cause corona discharge in the air introduced into the inlets of the plurality of air channels.

In an exemplary embodiment, the dust-collecting body may be made of an insulative material. The interior surfaces of the air channels may provide dust-collecting surfaces on which dust particles are collected. In another exemplary embodiment, the discharge unit may include a first discharge electrode and a second discharge electrode. The first and second discharge electrodes may be respectively attached to lower and upper portions of the air channels and may be positioned adjacent to each other through the discharge apertures, and may cause corona discharge in the air introduced into the inlets of the air channels.

In another exemplary embodiment, the first discharge electrode may be connected to a positive (+) pole of a voltage generator, and the second discharge electrode may be connected to a negative (−) pole of the voltage generator. In some exemplary embodiments, the second discharge electrode may include discharge tips configured to discharge voltage from the first discharge electrode.

Further, the dust-collecting electrodes may include a first dust-collecting electrode and a second dust-collecting electrode, which are respectively attached to lower and upper surfaces of the dust-collecting body to collect dust particles. The dust-collecting electrode and a second dust-collecting electrode may be ionized by the corona discharge, on wall surfaces of the air channels using an electric field. In addition, the first dust-collecting electrode may be connected to a positive (+) pole of the voltage generator, and the second dust-collecting electrode may be connected to a negative (−) pole of the voltage generator.

By virtue of the above-described solutions, the present invention may offer the following effects.

First, the electrical dust-collecting filter may be constructed to integrally form a discharge unit with a dust-collecting unit at the inlets of air channels of the dust-collecting unit, thereby reducing the size and volume of the filter.

Second, due to the reduction of the size and volume of the electrical dust-collecting filter, the electrical dust-collecting filter may be disposed within a narrow space in a vehicle when an air conditioning apparatus is positioned therein.

Third, the electrical dust-collecting filter may be used as a filter for a vehicular air conditioning apparatus over an extended duration of time in place of a conventional non-woven filter, which typically requires frequent replacement.

BRIEF DESCRIPTION OF THE DRAWINGS

The above and other features of the present invention will now be described in detail with reference to exemplary embodiments thereof, illustrated in the accompanying drawings which are given hereinbelow by way of illustration only, and thus are not limitative of the present invention, and wherein.

Figure 1:
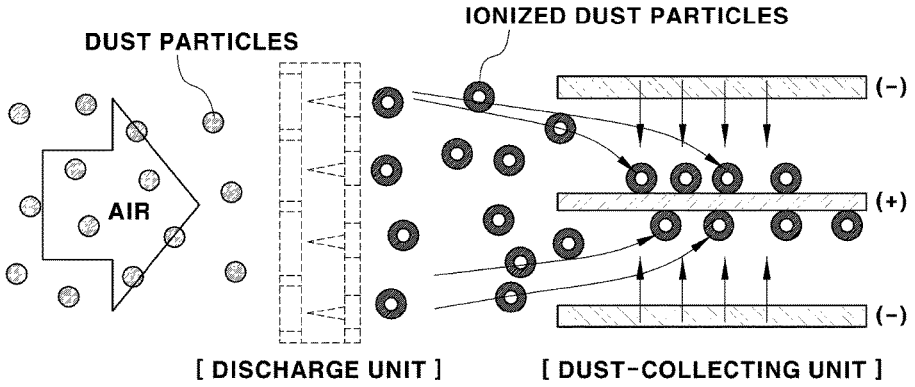
FIG. 1 PRIOR ART
FIG. 1 is an exemplary cross-sectional view showing the electrical dust-collecting filter according to the related art.

Reference numerals set forth in the Drawings include reference to the following elements as further discussed below:

10: dust-collecting body

12: air channel

14: discharge hole

16: first dust-collecting electrode
18: second dust-collecting electrode
21: first discharge electrode
22: second discharge electrode
23: conductive discharge tips
30: voltage generator It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes, will be determined in part by the particular intended application and use environment. In the figures, reference numbers refer to the same or equivalent parts of the present invention throughout the several figures of the drawing.

DETAILED DESCRIPTION

Hereinafter, reference will now be made in detail to various exemplary embodiments of the present invention, examples of which are illustrated in the accompanying drawings and described below. While the invention will be described in conjunction with exemplary embodiments, it will be understood that the present description is not intended to limit the invention to those exemplary embodiments. On the contrary, the invention is intended to cover not only the exemplary embodiments, but also various alternatives, modifications, equivalents and other exemplary embodiments, which may be included within the spirit and scope of the invention as defined by the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, an exemplary embodiment of the present invention will be described in detail with reference to the accompanying drawings. As shown in FIG. 1, a conventional electrical dust-collecting filter may include a discharge unit adapted to cause corona discharge in introduced air to ionize dust particles in the air, and a dust-collecting unit configured to collect the ionized dust particles. Accordingly, as corona discharge occurs in the introduced air (e.g., outdoor air external to a vehicle) in the discharge unit, the dust particles in the air may be ionized.

At this time, the ionized dust particles may be adsorbed and collected on the dust-collecting unit. Simultaneously, the clean air, from which the dust particles have been removed, may be introduced into an interior space (e.g., a passenger compartment of a vehicle) through the dust-collecting unit. However, a conventional electrical dust-collecting filter may be constructed with separation between the discharge unit and the dust-collecting unit. In other words, the discharge unit may separately disposed external to an air channel of the dust-collecting unit, the discharge unit and the dust-collecting unit maybe separately manufactured, thereby increasing the overall size and volume of the electrical dust-collecting filter.

Furthermore, since such a conventional electrical dust-collecting filter has an increased size and volume, there may be added complexities to provide an additional space within the narrow area in which an air conditioning apparatus may be mounted and further complexities may be involved with the placement of the electrical dust-collecting filter in the additional space. Accordingly, the present invention may provide a more compact electrical dust-collecting filter. In particular, the dust-collecting filter may include a discharge unit that may be integrally constructed with a dust-collecting unit disposed at the inlets of air channels of the dust-collecting unit with a reduction in the size and volume of the filter when compared to a conventional dust-collecting filter that has a discharge unit and a dust-collecting unit separate from each other.

Figure 2:
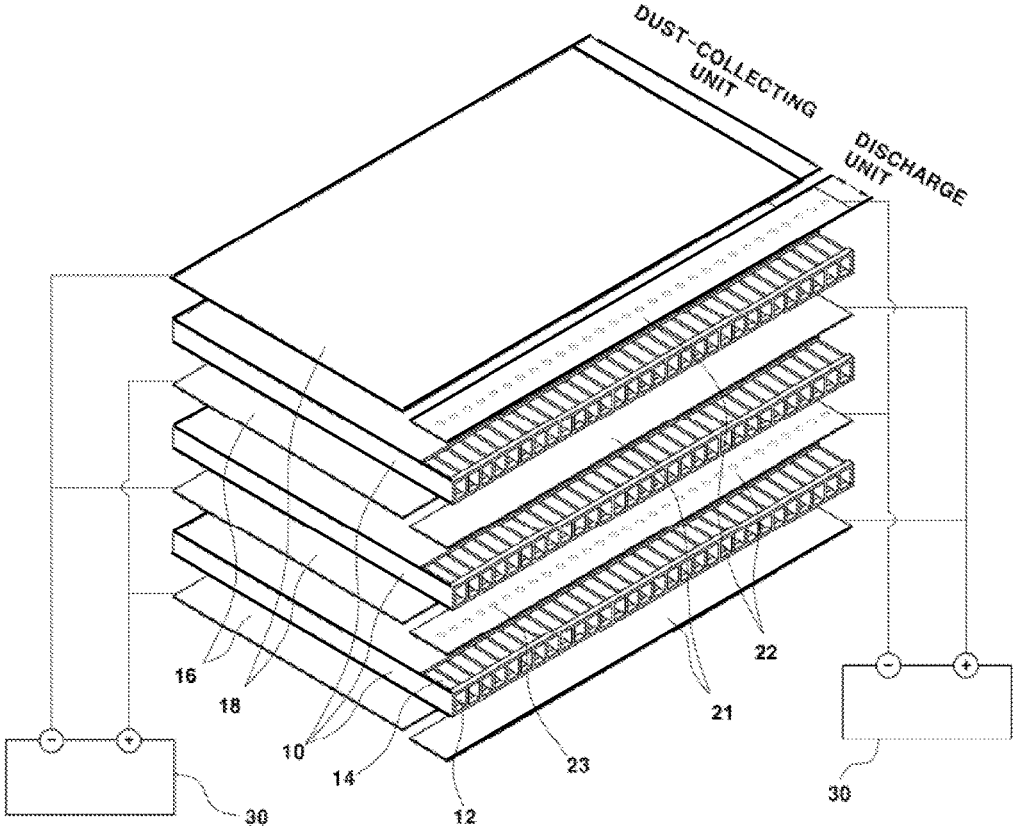
FIG. 2 is an exemplary schematic view showing the operating principle of an electrical dust-collecting filter according to an exemplary embodiment of the present invention.
Figure 3:
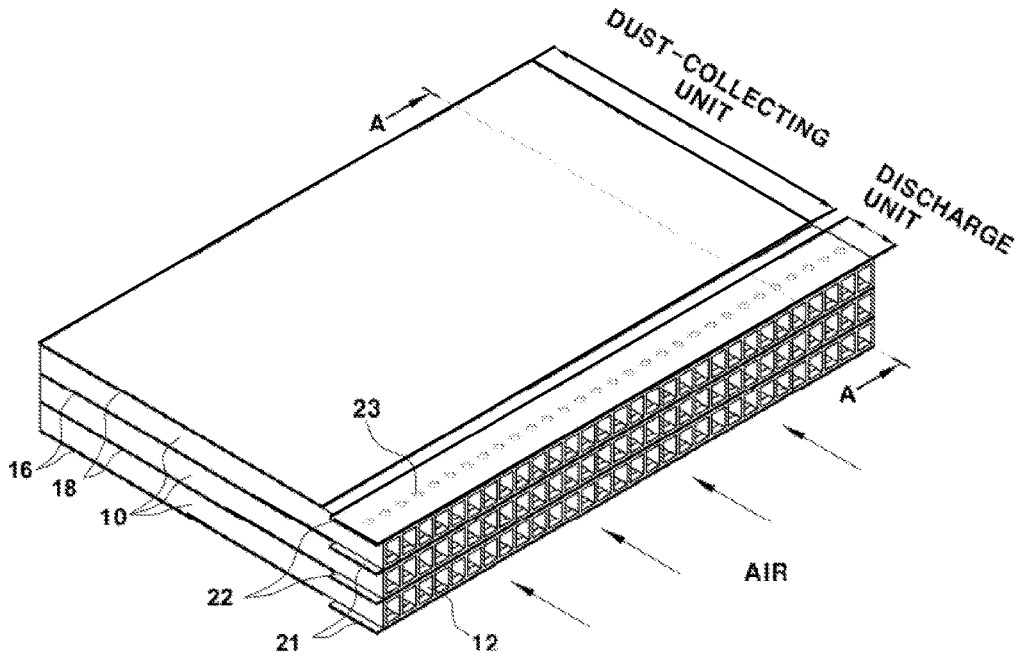
FIG. 3 is an exemplary exploded perspective view showing an electrical dust-collecting filter according to an exemplary embodiment of the present invention.
Figure 4:
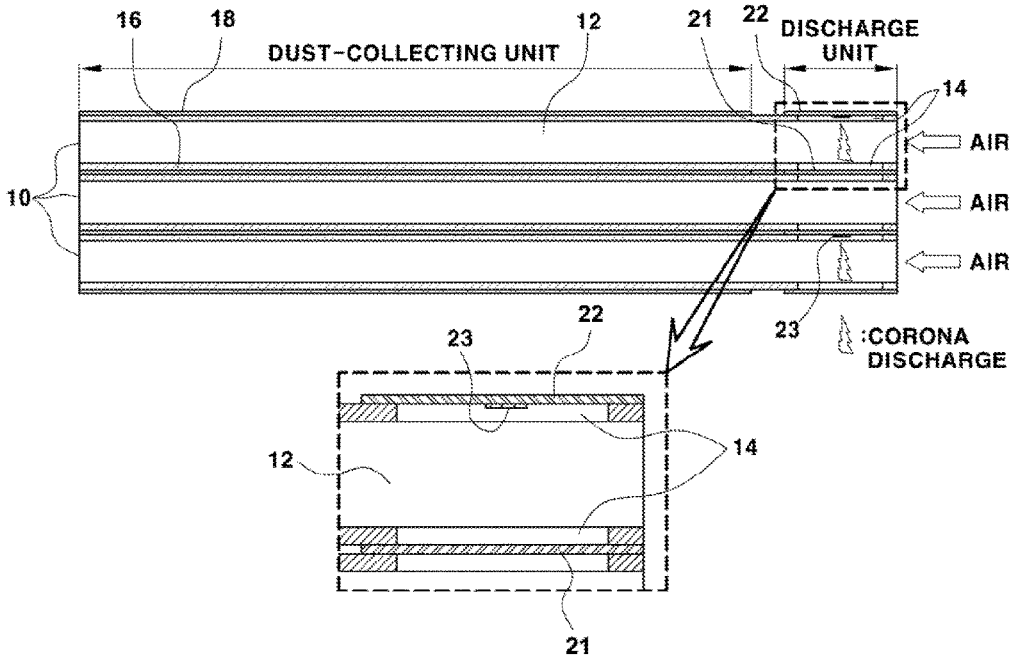
FIG. 4 is an exemplary assembled perspective view showing the electrical dust-collecting filter according to an exemplary embodiment of the present invention.

In the accompanying drawings, FIGS. 2 and 3 show an exemplary detailed view and an exemplary assembled cross-sectional view, respectively. FIG. 4 is an exemplary cross-sectional view taken along line A-A of FIG. 3. In FIGS. 2 to 4, reference numeral "10" denotes a dust-collecting body of the dust-collecting unit. The dust-collecting body 10 may be a component configured to be adapted to adsorb and collect dust particles in the air. The dust-collecting body may be made of an insulating material such as a plastic and may therein include a plurality of air channels 12. The air channels 12 may be laterally formed through the dust-collecting body 10.

In particular, the dust-collecting body 10 may include discharge apertures 14 formed in upper and lower surfaces thereof at the inlets of the air channels. For example, the interior wall surfaces of the air channels 12 in the dust-collecting body 10 may serve as dust-collecting surfaces on which dust, ionized by the discharge unit, may be adsorbed. The discharge unit may be integrally formed with the dust-collecting body 10 at the inlets of the air channels 12 and may facilitate the corona discharge in the air introduced to be into the inlets of the air channels 12.

More specifically, the discharge unit may include a first discharge electrode 21 and a second discharge electrode 22 that may be disposed respectively, at lower and upper faces of the discharge apertures 14 of the dust-collecting body 10. The first discharge electrode 21 and the second discharge electrode 22 may be adjacent to each other, and the discharge apertures 14 may be defined therebetween. The first discharge electrode 21 may be connected to the positive pole (+) of a voltage generator 30 and may be configured to apply high voltage. The second discharge electrode 22 may be connected to the negative pole (−) of the voltage generator 30. The second discharge electrode 22 may include conductive discharge tips 23, that may be printed at locations adjacent to the first discharge electrode 21, and may facilitate voltage discharge from the first discharge electrode 21.

Accordingly, the high voltage, applied to the first discharge electrode 21 from the voltage generator 30, may be discharged to the second discharge electrode 22 via the conductive discharge tips 23. Then, the corona discharge in the air may be introduced into the inlets of the air channels of the dust-collecting body 10. Additionally, the electrical dust-collecting filter may include dust-collecting electrodes, which may be additional components of the dust-collecting unit that create an electric field in the dust-collecting body 10.

More specifically, the dust-collecting electrodes may include a first dust-collecting electrode 16, coupled (e.g., attached) to the lower surface of the dust-collecting body 10 and spaced apart (e.g., separated) from the first discharge electrode 21. A second dust-collecting electrode 18, may be coupled (e.g., attached) to the upper surface of the dust-collecting body 10 while being spaced apart (e.g., separated) from the second discharge electrode 22. The first dust-collecting electrode 16 may be connected to the positive pole (+) of the voltage generator 30, and the second dust-collecting electrode 18 may be connected to the negative pole (−) of the voltage generator 30. The first and second dust-collecting electrodes 16 and 18, attached to lower and upper surfaces of the dust-collecting body 10, may be configured to generate an electrical field in the dust-collecting body 10. For example, the dust particles may be ionized via the corona discharge, which may facilitate an improved adsorption and collection on the interior wall surface of the air channels 12 due to the electrical field.

The operation of collecting dust in the air by the electrical dust-collecting filter according to an exemplary embodiment of the present invention, which is constructed in this manner, will now be described. As shown in FIG. 3, air may be introduced into the air channels 12 in the dust-collecting body 10 that may be a component of the dust-collecting unit. The high voltage, may be applied from the voltage generator 30 to the first discharge electrode 21, and may be discharged to the second discharge electrode 22 through the conductive discharge tips 23. Accordingly, thereby causing corona discharge in the air introduced into the inlets of the air channels 12. Consequently, the second discharge electrode 22 may be configured to emit negative (−) charges through the corona discharge, and the emitted negative (−) charges may collide with dust particles in the air, In particular, the collision may cause the dust particles to become electrically charged with the negative (−) polarity. In other words, the dust particles in the air may be ionized through the corona discharge.

Subsequently, the dust particles electrically charged with the negative (−) polarity may flow toward the dust-collecting zone in the dust-collecting body 10 from the inlets of the air channels 12. When high voltage is applied to the first dust-collecting electrode 16 from the voltage generator 30, the first dust-collecting electrode 16 may cooperate with the second dust-collecting electrode 18, connected to the negative (−) pole of the voltage generator 30, and may be configured to generate an electrical field in the dust-collecting body 10. By generation of the electrical field in the dust-collecting body 10, the dust particles, are ionized through the corona discharge, and may be adsorbed and collected on the interior wall surface of the air channels 12.

More specifically, the ionized dust particles may be subjected to a repulsive force with respect to the second dust-collecting electrode 18, which has the same polarity, and may be subjected to an attractive force with respect to the first dust-collecting electrode 16, which has the opposite polarity, while the ionized dust particles pass through the air channels 12 in the dust-collecting body 10. Accordingly, the dust particles may be collected on the interior wall surface of the air channels 12, which may be positioned close to the first dust-collecting electrode 16, by the attractive force.

As is apparent from the above description, the exemplary embodiment provides a compact electrical dust-collecting filter. Namely, the discharge unit may be integrally constructed with a dust-collecting unit and may be disposed at the inlets of air channels of the dust-collecting unit to reduce the size and volume of the filter. Conversely, in a conventional dust-collecting filter a discharge unit and a dust-collecting unit are provided separately from each other. Furthermore, the reduction in the size and volume of the electrical dust-collecting filter may enable the electrical dust-collecting filter to be easily installed in a narrow space in a vehicle in which an air conditioning apparatus is installed. Additionally, since maintenance requires merely removing collected dust by washing, the electrical dust-collecting filter may be used as a filter for a vehicular air conditioning apparatus over an extended duration of time in place of a conventional non-woven filter which requires frequent replacement.

The invention has been described in detail with reference to an exemplary embodiment thereof. However, it will be appreciated by those skilled in the art that changes may be made in the exemplary embodiment without departing from the principles and spirit of the invention, the scope of which is defined in the appended claims and their equivalents.

What is claimed is:

1. An electrical dust-collecting filter, comprising:

a dust-collecting unit including a dust-collecting body and dust-collecting electrodes configured to generate an electrical field in the dust-collecting body, the dust-collecting body having a plurality of air channels defined by a plurality of through holes laterally formed to pass through the dust-collecting body and discharge apertures formed in upper and lower surfaces thereof at inlets of the plurality of air channels; and a discharge unit, integrally formed with the dust-collecting unit at the inlets of the plurality of air channels to cause corona discharge in air introduced into the inlets of the plurality of air channels.

2. The electrical dust-collecting filter of claim 1, wherein the dust-collecting body is made of an insulative material and interior wall surfaces of the air channels serve as dust-collecting surfaces on which dust particles are collected.

3. The electrical dust-collecting filter of claim 1, wherein the discharge unit includes a first discharge electrode and a second discharge electrode, respectively attached to lower and upper portions of the air channels disposed adjacent to each other through the discharge apertures, thereby causing the corona discharge in air introduced into the inlets of the air channels.

4. The electrical dust-collecting filter of claim 3, wherein the first discharge electrode is connected to a positive pole of a voltage generator, and the second discharge electrode is connected to a negative pole of the voltage generator.

5. The electrical dust-collecting filter of claim 3, wherein the second discharge electrode includes discharge tips where voltage discharge from the first discharge electrode occurs.

6. The electrical dust-collecting filter of claim 1, wherein the dust-collecting electrodes include a first dust-collecting electrode and a second dust-collecting electrode, which are respectively attached to lower and upper surfaces of the dust-collecting body to collect dust particles, which are ionized by the corona discharge, on wall surfaces of the air channels using an electric field.

7. The electrical dust-collecting filter of claim 6, wherein the first dust-collecting electrode is connected to a positive pole of a voltage generator, and the second dust-collecting electrode is connected to a negative pole of the voltage generator.

8. An electrical dust-collecting filter, comprising:

a dust-collecting unit including a dust-collecting body and dust-collecting electrodes configured to generate an electrical field in the dust-collecting body, the dust-collecting body having a honeycomb sheet-like structure in which a plurality of air channels is laterally formed through the dust-collecting body and discharge apertures are formed in upper and lower surfaces thereof at inlets of the plurality of air channels; and a discharge unit, integrally formed with the dust-collecting unit at the inlets of the plurality of air channels to cause corona discharge in air introduced into the inlets of the plurality of air channels.

* * * * *